US006615840B1

(12) United States Patent
Fournier et al.

(10) Patent No.: US 6,615,840 B1
(45) Date of Patent: Sep. 9, 2003

(54) ELECTRICAL SMOKING SYSTEM AND METHOD

(75) Inventors: Jay A Fournier, Richmond, VA (US); John B. Paine, III, Midlothian, VA (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 10/076,101

(22) Filed: Feb. 15, 2002

(51) Int. Cl.[7] ..... A24F 1/22

(52) U.S. Cl. ..... 131/194; 131/360; 131/361; 131/365; 131/334

(58) Field of Search ..... 131/194, 360, 131/361, 365, 331, 332, 334

(56) References Cited

U.S. PATENT DOCUMENTS

| | | | | |
|---|---|---|---|---|
| 5,060,671 | A | 10/1991 | Counts et al. | |
| 5,105,837 | A * | 4/1992 | Barnes et al. | 131/365 |
| 5,144,962 | A | 9/1992 | Counts et al. | |
| 5,372,148 | A | 12/1994 | McCafferty et al. | |
| 5,388,594 | A | 2/1995 | Counts et al. | |
| 5,498,855 | A | 3/1996 | Deevi et al. | |
| 5,499,636 | A | 3/1996 | Baggett et al. | |
| 5,505,214 | A | 4/1996 | Collins et al. | |
| 5,530,225 | A | 6/1996 | Hajaligol | |
| 5,591,368 | A | 1/1997 | Fleischhauer et al. | |
| 5,665,262 | A | 9/1997 | Hajaligol et al. | |
| 5,666,976 | A | 9/1997 | Adams et al. | |
| 5,666,978 | A | 9/1997 | Counts et al. | |
| 5,692,291 | A | 12/1997 | Deevi et al. | |
| 5,692,525 | A | 12/1997 | Counts et al. | |
| 5,708,258 | A | 1/1998 | Counts et al. | |
| 5,750,964 | A | 5/1998 | Counts et al. | |
| 5,902,501 | A | 5/1999 | Nunnally et al. | |
| 5,915,387 | A | 6/1999 | Baggett et al. | |
| 5,934,289 | A | 8/1999 | Watkins et al. | |
| 5,954,979 | A | 9/1999 | Counts et al. | |
| 5,967,148 | A | 10/1999 | Harris et al. | |
| 5,988,176 | A | 11/1999 | Baggett et al. | |
| 6,026,820 | A | 2/2000 | Baggett et al. | |
| 6,040,560 | A | 3/2000 | Fleischhauer et al. | |
| 6,289,898 | B1 * | 9/2001 | Fournier et al. | 131/365 |

OTHER PUBLICATIONS

Notification of Transmittal of the International Search Report or the Declaration for PCT/US03/04235 dated Apr. 24, 2003.

* cited by examiner

*Primary Examiner*—Steven P. Griffin
*Assistant Examiner*—Dionne A. Walls
(74) *Attorney, Agent, or Firm*—Burns, Doane, Swecker & Mathis, LLP

(57) ABSTRACT

An electrical smoking system comprising a cigarette and an electric lighter, wherein the cigarette comprises a wrapper surrounding a tubular tobacco mat partially filled with material tobacco so as to define a filled tobacco rod portion and an unfilled tobacco rod portion. The wrapper includes an ammonium containing compound filler therein effective to reduce gaseous components of the tobacco smoke produced during smoking of the cigarette. The system includes a lighter comprising at least one heating blade and a controller adapted to control heating of the heater blade, the lighter arranged to at least partially receive the cigarette such that the heater blade heats a heating zone of the cigarette. The controller is operable to limit heating of the heater blade to a predetermined temperature range which allows delivery of tobacco smoke generated by heating the tobacco rod portion while reducing the content of at least one gaseous component in the tobacco smoke compared to smoking a cigarette having only calcium carbonate as the wrapper filler. The gaseous components which can be reduced include carbon monoxide, 1,3-butadiene, isoprene, acrolein, acrylonitrile, hydrogen cyanide, o-toluidine, 2-naphtylamine, nitrogen oxide, benzene, NNN, phenol, catechol, benz(a)anthracene, and benzo(a)pyrene.

31 Claims, 10 Drawing Sheets

ELECTRICAL SMOKING SYSTEM AND METHOD

FIELD OF INVENTION

The present invention relates to electrical smoking systems and methods of reducing gaseous components during smoking.

BACKGROUND OF INVENTION

Traditional cigarettes are consumed by lighting an end of a wrapped tobacco rod and drawing air predominately through the lit end by suction at a mouthpiece end of the cigarette. Traditional cigarettes deliver smoke as a result of combustion, during which a mass of tobacco is combusted at temperatures which often exceeds 800° C. during a puff. The heat of combustion releases various gaseous combustion products and distillates from the tobacco. As these gaseous products are drawn through the cigarette, they cool and condense to form a smoke containing the tastes and aromas associated with smoking. Traditional cigarettes produce sidestream smoke during smoldering between puffs. Once lit, they must be fully consumed or be discarded. Relighting a traditional cigarette is possible but is usually an unattractive proposition to a discerning smoker for subjective reasons (flavor, taste, odor).

In an electrical smoking system, it is desirable to deliver smoke in a manner that meets the smokers experiences with more traditional cigarettes, such as an immediacy response (smoke delivery occurring instant upon draw), a desired level of delivery (which correlates with FTC tar level), together with a desired resistance to draw (RTD) and consistency from puff to puff and from cigarette to cigarette.

Commonly assigned U.S. Pat. Nos. 5,060,671; 5,144,962; 5,372,148; 5,388,594; 5,498,855; 5,499,636; 5,505,214; 5,530,225; 5,591,368; 5,665,262; 5,666,976; 5,666,978; 5,692,291; 5,692,525; 5,708,258; 5,750,964; 5,902,501; 5,915,387; 5,934,289; 5,954,979; 5,967,148; 5,988,176; 6,026,820 and 6,040,560 disclose electrical smoking systems and methods of manufacturing a cigarette, which patents are incorporated by reference.

SUMMARY OF INVENTION

The invention provides an electrical smoking system which includes a cigarette and a lighter. The cigarette comprises a tubular tobacco mat partially filled with tobacco material so as to define a filled tobacco rod portion, the filled tobacco rod portion being adjacent a free end of cigarette. The cigarette includes a wrapper surrounding the filled tobacco rod portion, the wrapper comprising a cellulosic web material and at least one filler therein, the filler comprising an ammonium containing compound in an amount effective to reduce the content of gaseous components in tobacco smoke produced upon combustion/pyrolysis of the tobacco rod portion. The lighter includes at least one heating blade and a controller adapted to control heating of the heater blade, the lighter arranged to at least partially receive the cigarette such that the heater blade heats a heating zone of the cigarette, the controller being operable to limit heating of the heating zone to no greater than 500° C. so as to produce tobacco smoke while reducing the content of at least one gaseous component in the tobacco smoke, the at least one gaseous component including carbon monoxide, 1,3-butadiene, isoprene, acrolein, acrylonitrile, hydrogen cyanide, o-toluidine, 2-naphtylamine, nitrogen oxide, benzene, NNN, phenol, catechol, benz(a)anthracene, and benzo(a)pyrene.

BRIEF DESCRIPTION OF THE DRAWINGS

Various features of the present invention are shown in the drawings in which like numerals indicate similar elements.

Detailed Description of the Preferred Embodiments

Figure 1:
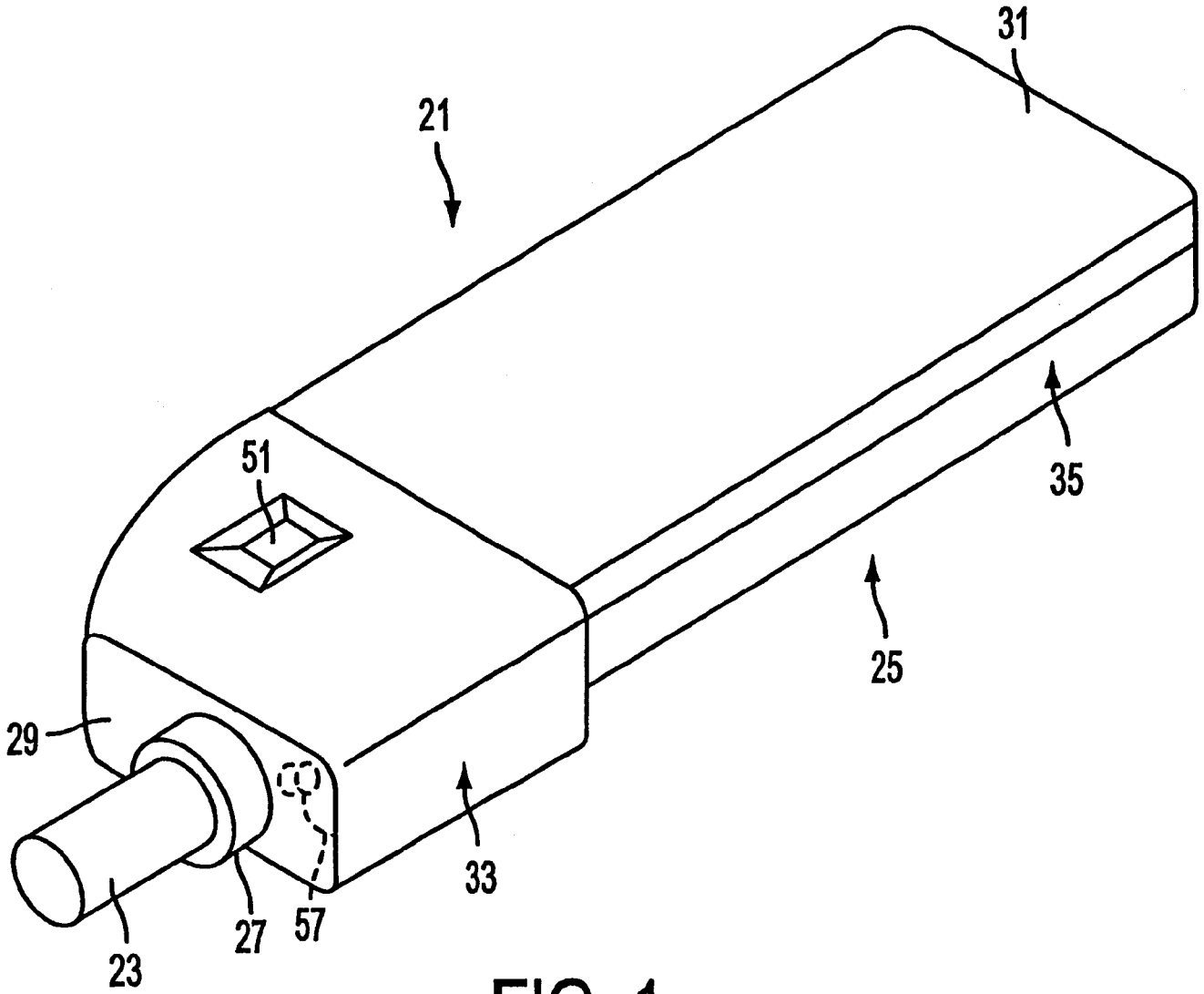
FIG. 1 is a perspective view of a smoking system in accordance with a preferred embodiment of the present invention with a cigarette of the system inserted into the electrically operated lighter.
Figure 2:
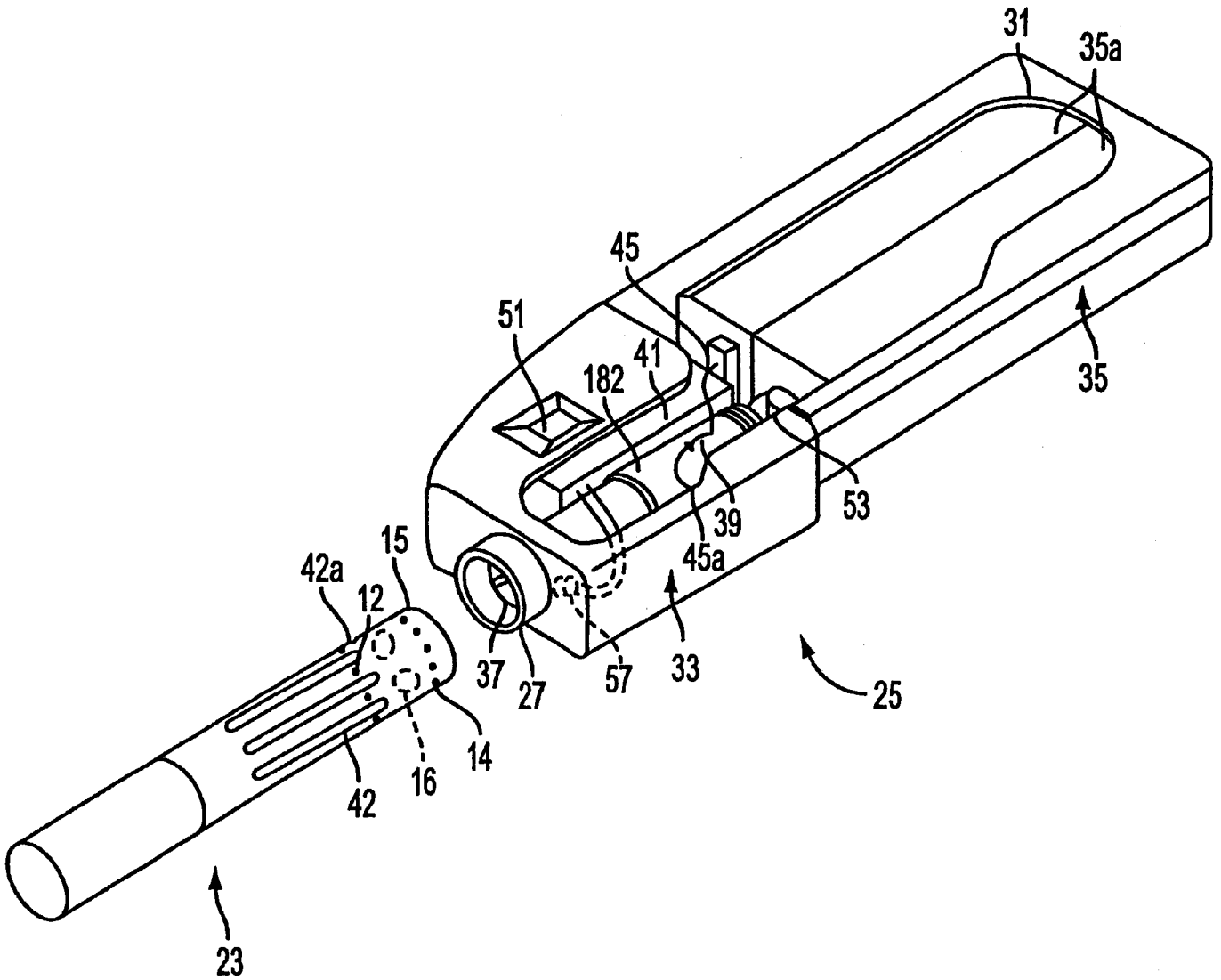
FIG. 2 is a perspective view of the smoking system of FIG. 1, but with the cigarette withdrawn from the lighter upon conclusion of a smoking.

Referring to FIGS. 1 and 2, a preferred embodiment of the present invention provides a smoking system 21 which preferably includes a partially-filled, filter cigarette 23 and a reusable lighter 25. The cigarette 23 is adapted to be inserted into and removed from a cigarette receiver 27 which is open at a front end portion 29 of the lighter 25. Once the cigarette 23 is inserted, the smoking system 21 is used in much the same fashion as a more traditional cigarette, but without lighting or smoldering of the cigarette 23. The cigarette 23 is discarded after one or more puff cycles.

Preferably, each cigarette 23 provides a total of eight puffs (puff cycles) or more per smoke; however it is a matter of design expedient to adjust to a lesser or greater total number of available puffs. In the preferred embodiment, the cigarette 23 includes at least one peripheral ring of perforations 12 located adjacent the free end 15 of the cigarette 23 and optionally a second ring or rings of perforations 14 and optionally a plurality of holes 16 underneath the outer wrapper of the cigarette 23.

The lighter 25 includes a housing 31 having front and rear housing portions 33 and 35. One or more batteries 35*a* are removably located within the rear housing portion 35 and supply energy to a heater fixture 39 which includes a plurality of electrically resistive, heating elements 37 (shown in FIGS. 3A–C). The heating elements 37 are arranged within the front housing portion 33 to slidingly receive the cigarette 23 along an intermediate portion of the cigarette receiver 27. A stop 183 located at the base 300 of the heater fixture 39 defines a terminus of the cigarette receiver 27.

A controller includes a control circuit 41 in the front housing portion 33 which selectively establishes electrical communication between the batteries 35*a* and one or more the heater elements 37 during execution of each puff cycle. The preferred embodiment of the present invention includes details concerning an air management system for effecting the admission and routing of air within the lighter, including aspects which are discussed in greater detail beginning with reference to FIG. 3C.

Still referring to FIGS. 1 and 2, preferably the rear portion 35 of the lighter housing 31 is adapted to be readily opened and closed, such as with screws or snap-fit components, so as to facilitate replacement of the batteries. If desired, an electrical socket or contacts may be provided for recharging the batteries in a charger supplied with house current or the like. Preferably, the front housing portion 33 is removably joined to the rear housing portion 35, such as with a dovetail joint or a socket fit.

The batteries 35*a* are sized to provide sufficient power for the heaters 37 to function as intended and preferably comprise a replaceable and rechargeable type. Alternate sources of power are suitable, such as capacitors. In the preferred embodiment, the power source comprises four nickel-cadmium battery cells connected in series with a total, non-loaded voltage in the range of approximately 4.8 to 5.6 volts. The characteristics of the power source are, however, selected in view of the characteristics of other components in the smoking system 21, particularly the characteristics of the heating elements 37. Commonly assigned U.S. Pat. No. 5,144,962, hereby incorporated by reference, describes several types of power sources useful in connection with the smoking system of the present invention, such as rechargeable battery sources and power arrangements which comprise a battery and a capacitor which is recharged by the battery.

Referring specifically to FIG. 2, preferably, the circuitry 41 is activated by a puff-actuated sensor 45 that is sensitive to either changes in pressure or changes in rate of air flow that occur upon initiation of a draw on the cigarette 23 by a smoker. The puff-actuated sensor 45 is preferably located within the front housing portion 33 of the lighter 25 and is communicated with a space inside the heater fixture 39 adjacent the cigarette 23 via a port 45*a* extending through a side wall portion 182 of the heater fixture 39. A puff-actuated sensor 45 suitable for use in the smoking system 21 is described in commonly assigned U.S. Pat. No. 5,060,671 and U.S. Pat. No. 5,388,594, the disclosures of which are incorporated herein by reference. The puff sensor 45 preferably comprises Fujikura Ltd. Model FSS-02 PG. Another suitable sensor is a Model 163PCO1D35 silicon sensor, manufactured by the MicroSwitch division of Honeywell, Inc., Freeport, Ill. Flow sensing devices, such as those using hot-wire anemometry principles, have also been successfully demonstrated to be useful for actuating an appropriate one of the heater elements 37 upon detection of a change in air flow. Once actuated by the sensor 45, the control circuitry 41 directs electric current to an appropriate one of the heater elements 37.

An indicator 51 is provided at a location along the exterior of the lighter 25, preferably on the front housing portion 33, to indicate the number of puffs remaining in a smoke of a cigarette 23. The indicator 51 preferably includes a seven-segment liquid crystal display. In the preferred embodiment, the indicator 51 displays a segmented image which correlates with the digit "8" when a cigarette detector 57 detects the presence of a cigarette in the heater fixture 39. The detector 57 preferably comprises an inductive coil 1102 adjacent the cigarette receiver 27 of the heater fixture 39 and electric leads 1104 that communicate the coil 1102 with an oscillator circuit within the control circuitry 41. The cigarette 23 internally bears a foil ring or the like which can affect inductance of the coil winding 1102 such that whenever a cigarette 23 is inserted into the receiver 27, the detector 57 generates a signal to the circuitry 41 indicative of the cigarette being present. The control circuitry 41 in turn provides a signal to the indicator 51. The display of the digit "8" on the indicator 51 reflects that the eight puffs provided on each cigarette 23 are available, i.e., no puff cycle has been undertaken and none of the heater elements 37 have been activated to heat the cigarette 23. After the cigarette 23 is fully smoked, the indicator displays the digit "0". When the cigarette 23 is removed from the lighter 25, the cigarette detector 57 no longer detects a presence of a cigarette 23 and the indicator 51 is turned off.

The operation and details of the inductive cigarette detector 57 is provided in commonly assigned U.S. Pat. No. 5,902,501, which is incorporated herein by reference in its entirety. Other detectors may be employed instead of the above-described one for the detector 57, such as a Type OPR5005 Light Sensor, manufactured by OPTEX Technology, Inc., 1215 West Crosby Road, Carrollton, Tex. 75006.

In the alternative to displaying the remainder of the puff count, the detector display may instead be arranged to indicate whether the system is active or inactive ("on" or "off").

As one of several possible alternatives to using the above-noted cigarette detector 57, a mechanical switch (not shown) may be provided to detect the presence or absence of a cigarette 23 and a reset button (not shown) may be provided for resetting the circuitry 41 when a new cigarette is inserted into the lighter 25, e.g., to cause the indicator 51 to display the digit "8", etc. Power sources, circuitry, puff-actuated sensors, and indicators useful with the smoking system 21 of the present invention are described in commonly assigned, U.S. Pat. Nos. 5,060,671; 5,388,594 and 5,591,368, all which are incorporated herein by reference.

Figure 3A:
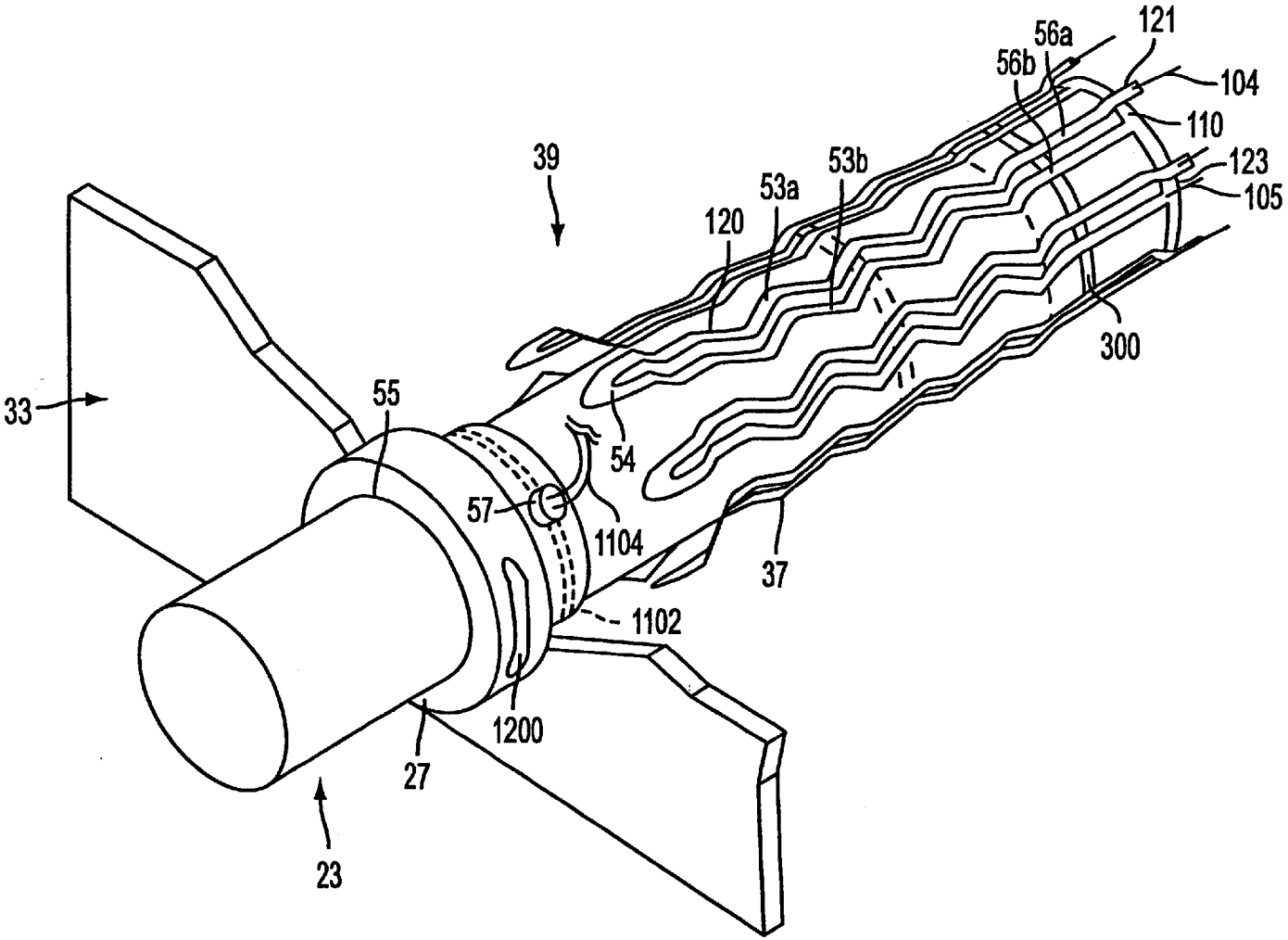
FIG. 3A is a partial perspective detail view of portions of the heater fixture of FIG. 1, including wavy hairpin heater elements and portions of a preferred air admission system.
Figure 3B:
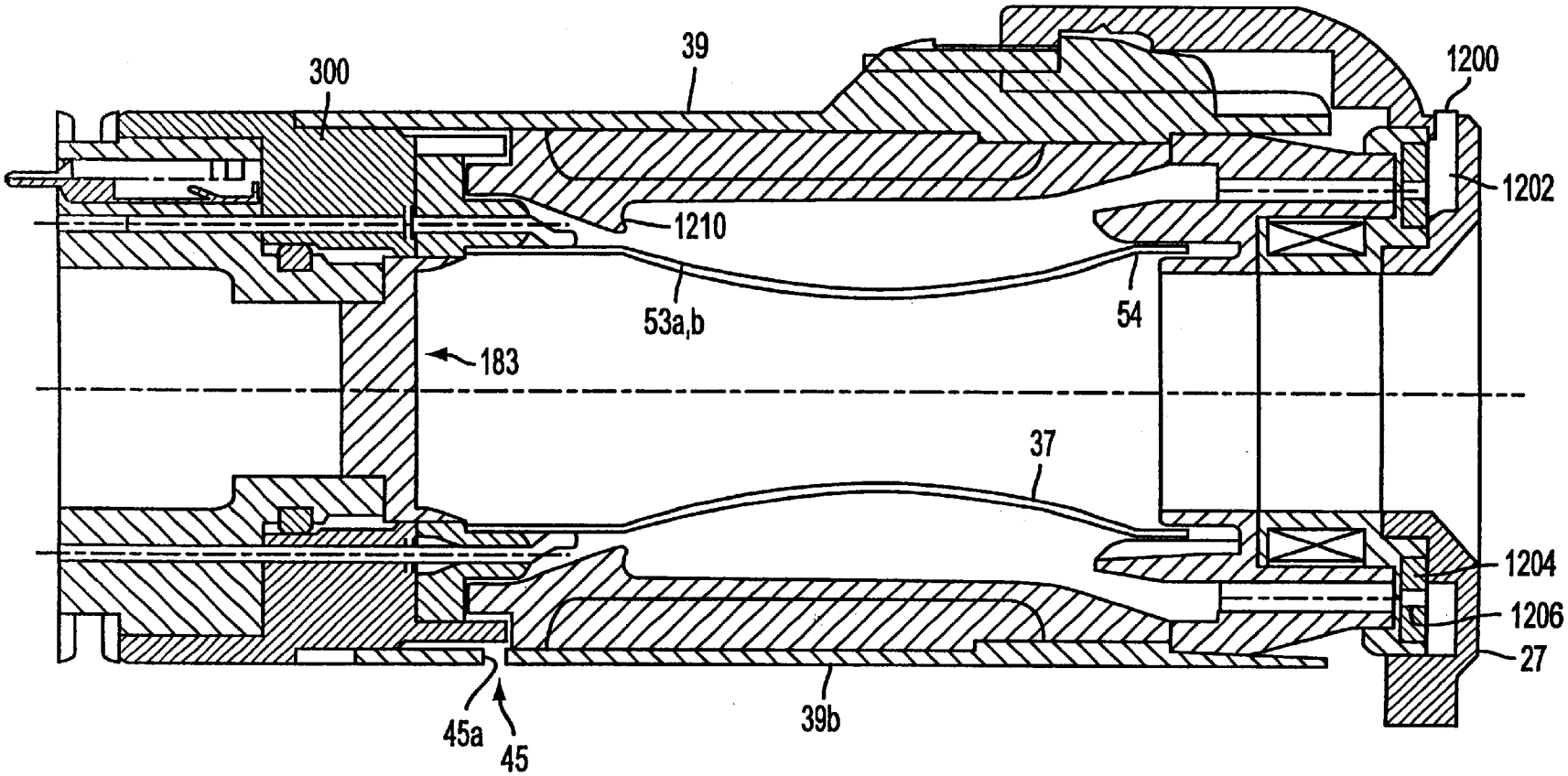
FIG. 3B is a sectional side view of a preferred heater fixture which includes the wavy hairpin heater elements of FIG. 3A.

Referring now to FIGS. 3A and 3B, the front housing portion 33 of the lighter 25 encloses a substantially cylindrical heater fixture 39 whose heater elements 37 slidingly receive the cigarette 23. The heater fixture 39 is adapted to support an inserted cigarette 23 in a fixed relation to the heater elements 37 such that the heater elements 37 are positioned alongside the cigarette 23 at approximately the same location along each newly inserted cigarette 23. In the preferred embodiment, the heater fixture 39 includes eight mutually parallel heater elements 37 which are disposed concentrically about the axis of symmetry of the cigarette receiver 27. The locations where each heater element 37 bears against (or is in thermal communication with) a fully inserted cigarette 23 is referred to herein as the heater footprint or char zone 42. In the preferred embodiment, the char zone may extend approximately 14 mm in length, beginning approximately 9 mm from the free-end 15 of the cigarette 23. Of course, these relations may be varied amongst different lighter and cigarette designs. In another model for example, the char zone 42 extends from 12 mm to 23 mm from the free-end of the cigarette 23.

Figure 3C:
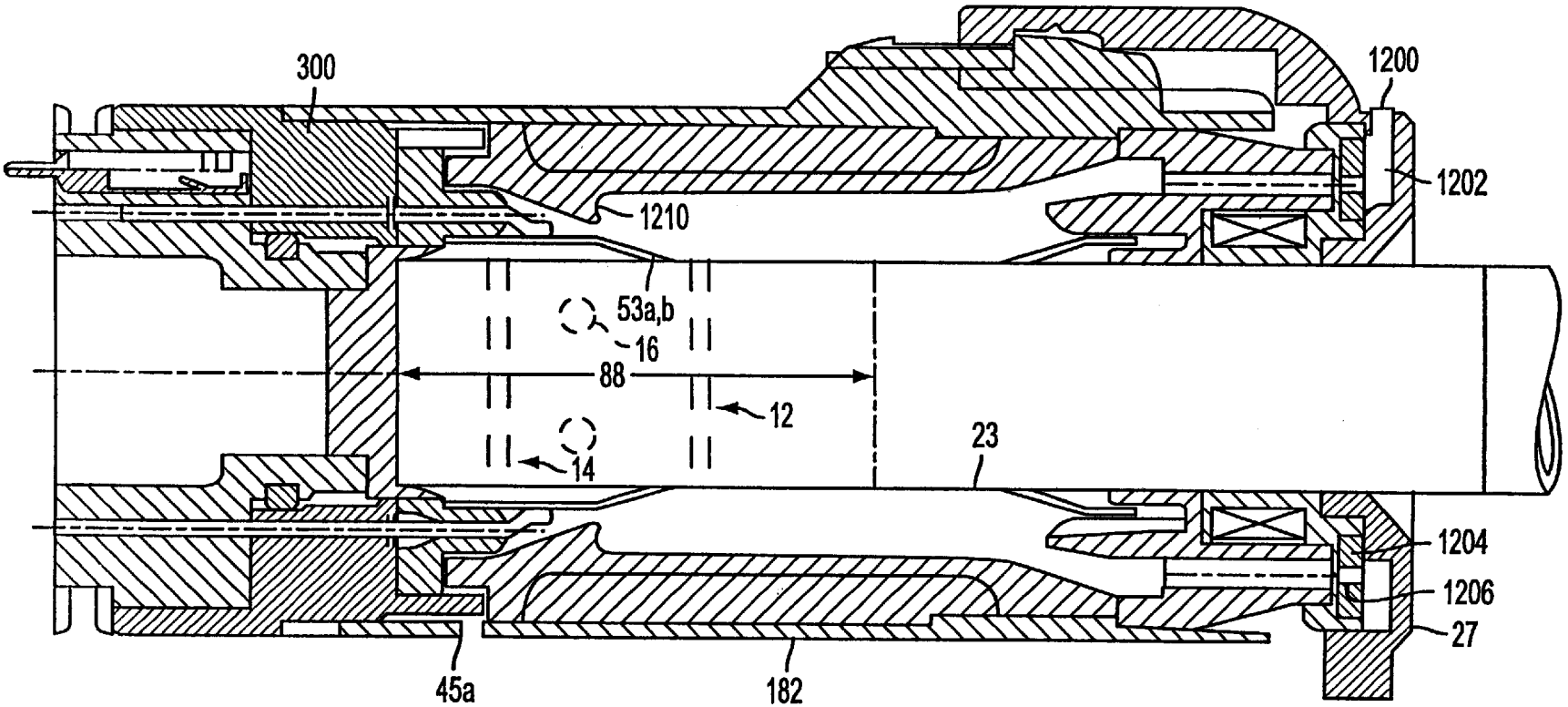
FIG. 3C is a side view of the cigarette shown in FIG. 4 inserted into the heater fixture of FIG. 6, with the latter being shown in cross-section.

Referring also to FIG. 3C, to assure consistent placement of the heating elements 37 relative to each cigarette 23 from cigarette to cigarette, the heater fixture 39 is provided with a base portion 300 having a cupped stop-piece 183 against which the free end 15 of the cigarette 23 is urged during its insertion into the cigarette receiver 27 of the lighter 25. The cupped shape of the stop-piece 183 is configured to close-off (occlude) the free end 15 of the cigarette 23 upon full insertion of the cigarette 23 so that air cannot be drawn through the free end 15, but instead only from along the side walls of the cigarette 23.

Still referring to FIGS. 3A and 3B, most preferably the heater elements 37 are of a design referred to herein as a wavy hairpin heater element 37, wherein each heater element 37 includes at least first and second serpentine, elongate members 53*a* and 53*b* which are adjoined at an end portion (tip) 54. The tips 54 are adjacent the opening 55 of the cigarette receiver 27. The opposite ends 56*a* and 56*b* of each heater element 37 are electrically connected to the opposite poles of the power source 35*a* as selectively established by the controller 41. More specifically, an electrical pathway through each heater fixture 37 is established, respectively, through a terminal pin 104, a connection 121 between the pin 104 and a free end portion 56*a* of one of the serpentine members 53*a*, through at least a portion of the tip 54 to the other serpentine member 53*b* and its end portion 56*b*. Preferably, an integrally formed, common connection ring 110 provides a common electrical connection amongst all the end portions 56*b* of the elongate member 53*b*. In the preferred embodiment, the ring 110 is connected to the positive terminal of the power source 35*a* (or common) through a connection 123 between the ring 110 and a pin 105. Further details of the construction and establishment of electrical connections in the heater fixture 39 are illustrated and described in the commonly assigned U.S. Pat. Nos. 5,060,671; 5,388,594 and 5,591,368, all which are incorporated herein by reference. The heater portions 53*a*, 53*b* and 54 establish what is here referred to as a heater blade 120.

Other preferred designs of the heater fixture 39 include heater elements in the form of a straight hairpin heater elements 37, which are set forth in the commonly assigned U.S. Pat. No. 5,591,368 and "singular serpentine" heater elements each which are set forth in commonly assigned U.S. Pat. No. 5,388,594, said patents being incorporated herein by reference in their entireties.

Additional heater fixtures 37 that are operable as part of the lighter 25 include those disclosed in commonly assigned, U. S. Pat. No. 5,665,262; and commonly assigned, U.S. Pat. No. 5,498,855, all which are incorporated herein by reference in their entireties.

Preferably, the heaters 37 are individually energized by the power source 35*a* under the control of the circuitry 41 to heat the cigarette 23 preferably eight times at spaced locations about the periphery of the cigarette 23. The heating renders eight puffs from the cigarette 23, as is commonly achieved with the smoking of a more traditional cigarette. It may be preferred to activate more than one heater simultaneously for one or more or all of the puffs.

Figure 4:
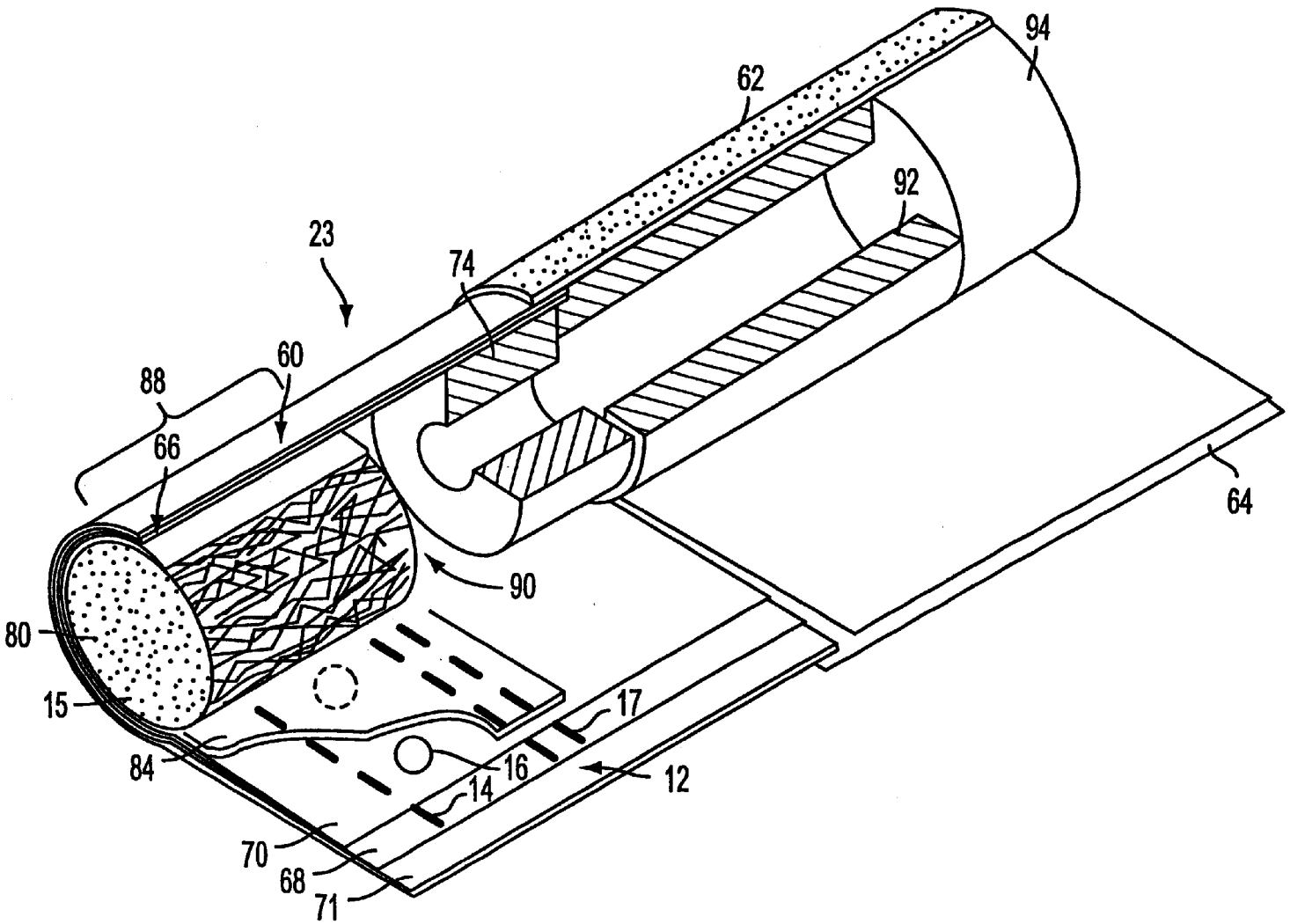
FIG. 4 is a detail perspective view of a preferred embodiment of the cigarette shown in FIG. 1, with certain components of the cigarette being partially unraveled.

Referring now to FIG. 4, the cigarette 23 is preferably constructed in accordance with the preferred embodiment set forth in commonly assigned, U.S. Pat. No. 5,499,636, herein incorporated by reference in its entirety.

Referring particularly to FIG. 3A, 3B, and 3C, preferably the puff sensor 45 is communicated to the interior of the heater fixture 39 through a port 45*a*. Preferably, the port 45*a* is located adjacent the base portion 300 of the heater fixture 39. Such location minimizes the risk that the port 45*a* and adjacent passageways leading thereto through the body of the heater fixture 39 would become clogged by the debris or smoke condensates.

The heater fixture 39 includes an air inlet port 1200, which communicates with a manifold 1202 that is at least partially defined by a perforated annulus 1204 and the body of the receiver 27. The annulus 1204 includes preferably four holes 1206 of approximately 0.029 inch diameter for effecting a minimal pressure drop as air is drawn into the lighter through the air inlet port 1200 and the manifold 1202. The size and number of the holes 1206 may be varied, but such are configured to provide sufficient pressure drop that upon drawing action upon an inserted cigarette 23, a pressure drop is induced upon the air entering the lighter such that the puff sensor 45 is operative to recognize initiation of a puff. In the preferred embodiment, the holes 1206 of the annulus 1204 induce an RTD of approximately 25 mm water plus or minus 5 mm. The range of pressure drop induced at the annulus 1204 should be selected such that it is within the range of pressure drop detectable by the pressure sensor 45, but minimized to that need so that the remainder of desired RTD (Resistance To Draw) is effected predominantly by the cigarette 23. In the preferred embodiment, a grand total RTD of 4 to 5 inches water (100 to 130 mm water) is desired and approximately 25 mm of that is produced at the annulus 1204. Accordingly, the RTD of the cigarette 23 is preferably in the range of approximately 75 to 105 mm water RTD, when inserted in lighter 25 and the induced pressure drop of the lighter 25 is approximately 25 mm water. Adjustment of cigarette RTD in accordance with the present invention includes provision of and adjustment of the number and extent of perforations 12 (and optionally 14) in the filled portion 88 of the cigarette 23.

Advantageously, the holes 1206 of the annulus 1204, being located adjacent the receiver 27, is positioned away from sources of debris and condensates which might otherwise tend to clog the holes 1206.

Air that has been drawn into the lighter upon initiation of a puff enters alongside the cigarette with a substantial longitudinal (axial) velocity component toward the base portion 300 of the heater fixture 300. It has been discovered that a flow deflector or annular air-swoop 1210 adjacent the base portion 300 enhanced smoke output (delivery) of the system 21 by directing at least a portion of the entering airflow back toward the inserted cigarette 23. Not wishing to be bound by theory, it is believed that the air-swoop 1210 tends to direct airflow toward regions of the cigarette 23 bearing perforations 12. Preferably, the annular air-swoop 1210 is located relative to a fully inserted cigarette 23 such that the air-swoop 1210 circumscribes the general location along the cigarette 23 of the perforations 12.

It has been discovered that the functioning of the air-swoop 1210 is improved if it is constructed from metal, or alternatively, all body portions of the heater fixture 39 are constructed from a metal such as a stainless steel, or at least those portions of the heater fixture 39 that are disposed adjacent an inserted cigarette 23. Such provision can provide an increase of delivery of 1 mg TPM (FTC).

The cigarette 23 comprises a tobacco rod 60 and a filter tipping 62, which are joined together with tipping paper 64. The tobacco rod 60 of the cigarette 23 preferably includes a tobacco web or "mat" 66 which has been folded into a tubular (cylindrical) form about a free-flow filter 74 at one of its ends and a tobacco plug 80 at the other. In the alternative, a plug of cellulose acetate might be used in place of the tobacco plug 80. The longitudinal (axial) extent of the tobacco plug 80 defines a tobacco filled portion 88 of the partially-filled cigarette 23.

An overwrap 71 is intimately enwrapped about the tobacco web 66 and is held together along a longitudinal seam as is common in construction of more traditional cigarettes. The overwrap 71 retains the tobacco web 66 in a wrapped condition about a free-flow filter 74 and a tobacco plug 80.

The tobacco web 66 itself preferably comprises a base web 68 and a layer of tobacco material 70 located along the inside surface of the base web 68. At the tipped end of the tobacco rod 60, the tobacco web 66 together with the overwrap 71 are wrapped about the tubular free-flow filter plug 74. Preferably, the tobacco plug 80 is constructed separately from the tobacco web 66 and comprises a relatively short column of cut filler tobacco that preferably has been wrapped within and retained by a plug wrap 84.

As a general matter, the length of the tobacco plug 80 is preferably set relative to the total length of the tobacco rod 60 such that a void 90 is established along the tobacco rod 60 between the free-flow filter 74 and the tobacco plug 80. The void 90 corresponds to an unfilled portion of the tobacco rod 60 and is in immediate fluid communication with the tipping 62 through the free flow filter 74 of the tobacco rod 60.

The tipping 62 preferably comprises a free-flow filter 92 located adjacent the tobacco rod 60 and a mouthpiece filter plug 94 at the distal end of the tipping 62 from the tobacco rod 60. Preferably, the free-flow filter 92 is tubular and transmits air with very little pressure drop. Other low efficiency filters of standard configuration could be used instead, however. The inside diameter for the free flow filter 92 is preferably at or between 2 to 6 mm and is preferably greater than that of the free flow filter 74 of the tobacco rod 60.

The mouthpiece filter plug 94 closes off the free end of the tipping 62 for purposes of appearance and, if desired, to effect some filtration, although it is preferred that the mouthpiece filter plug 94 comprise a low efficiency filter of preferably about 15 to 25 percent efficiency.

Still referring to FIG. 4, preferably, the partially-filled cigarette 23 includes at least one row of perforations 12 at a location adjacent the free end 15 of the tobacco rod portion of the cigarette 23. Preferably, the row of perforations 12 are twelve holes in count and may be formed as slits 17 (perf-holes) at a 400 microsecond pulse width setting of a Hauni Model 500-1 on-line laser perforator system. Each perf-hole 17 of the row of perforations 12 preferably extends through the outer wrapper 71, through the tobacco mat 66 and the plug wrap 84.

Referring now also FIG. 2, preferably, the row of perforations 12 is located at or adjacent to end portion 42*a* of the char zone 42. Such placement is believed to promote entrance of heated air into the tobacco plug 80 and create other additional favorable effects upon pyrolysis during a puff cycle such that delivery (TPM-FTC) is enhanced.

To further improve delivery, additional row or rows of perforations 14 comprising perf holes 17 as previously described may be provided at a location along the filled portion 88 of the tobacco rod 60 preferably, at a location superposed, or at least partially superposed, by the heater char zone or footprint 42 and/or alternatively, adjacent the free end 15 of the cigarette 23. In the latter alternate embodiment, the second row of perforations 14 is established at approximately 4 mm from the free end 15 of the cigarette 23. Either or both of the perforation rows 12 or 14 may comprise a single row or a dual row of perf-holes 17.

The number and extent of perf-holes 17 are resolved in accordance with two countervailing considerations. The addition of rows of perforation 12, 14 as described above contributes to enhanced delivery of the cigarette 23. However, each additional row of perforations 12, 14 reduces RTD along the side walls of the cigarettes 23. Preferably, the grand total RTD of the electrical smoking system 21 should provide the smoker a resistance to draw approximately the same as that experience with traditional cigarettes of approximately 4 to 5 inches water (approximately 100–130 mm water) or thereabouts, 80–130 mm water.

It has been found that at a total energy input of 23.8 Joules to a heater element 37, a cigarette 23 bearing a dual row of perforations 12 at a location 12 mm from the free end 15 of the cigarette (dual rows of 12 holes each) can produce deliveries substantially greater than 3 milligrams TPM (FTC). Further deliveries may be obtained by addition of a second row or rows of perforations 14.

However, each additional row of perf-holes 17 lowers RTD, which preferably is to remain at or above 100 mm water for the whole system 21. Should one find that for a given cigarette 23, additional delivery is desired yet the RTD level is nearing its lower limit, additional delivery can be obtained by provision of a plurality of circumferentially spaced-apart holes 16 placed in the mat 66 itself. Preferably, the mat holes 16 are each approximately one mm in diameter and preferably 6 in number so that the requisite tensile strength of the mat material 66 is maintained and may withstand machine manufacturing. The mat holes can be formed with apparatus as is described in commonly assigned U.S. Pat. No. 5,666,976, which patent is hereby incorporated by reference in its entirety.

Preferably, the holes 16 in the mat 66 are covered by the outer wrapper 71. Preferably, any row of perforations 12, 14 is displaced away from the location of the row of mat holes 16 so that they do not overlap. In a preferred embodiment, the mat holes 16 are located approximately 7 mm from the free-end 15 of the cigarette 23, and a dual row of perforations 12 is established approximately 12 mm from the end 15 of the cigarette 23. So arranged, the cigarette achieves a 6 mg TPM (FTC) or more. Advantageously, the mat holes 16 can contribute an additional delivery to the cigarette 23 without the same extent of reduction in RTD as is experienced with each addition of row of perf-holes 17. Accordingly, one may utilize the rows of perforations 12, 14 to approximate desired delivery levels for the cigarette 23, with the mat holes 16 being used to adjust or increase delivery with a lesser effect on RTD.

More traditional cigarettes exhibit a resistance to draw (RTD) of approximately 80 mm to 130 mm water. The lighter of the electrical smoking system according to the present invention when tested without a cigarette exhibits an RTD of approximately 20–30 mm water. The cigarettes according to the present invention having the laser perforations and mat holes as taught herein exhibit an RTD of approximately 20–30 mm water when drawn upon by themselves (outside of the lighter of the electrical smoking system), but when inserted, the electrical smoking system (the lighter and the fully inserted cigarette) generate an RTD of approximately 50–75 mm water.

Figure 5:
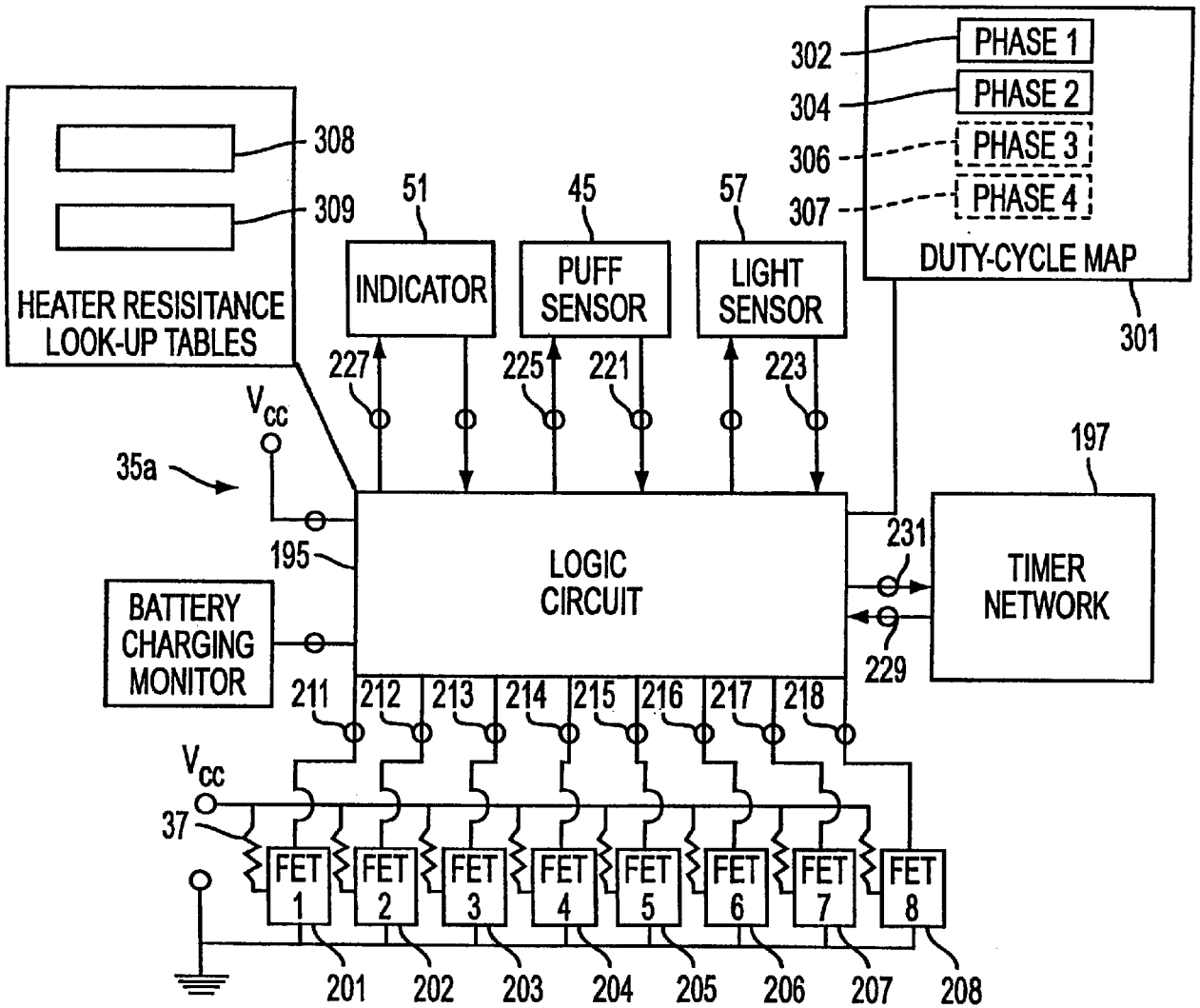
FIG. 5 is a schematic, block-diagram of a preferred control circuit for the lighter shown in FIGS. 1 and 2.

Referring now to FIGS. 2 and 5, the electrical control circuitry 41 of the lighter 25 includes a logic circuit 195, which preferably comprises a micro-controller or an application specific, integrated circuit (or "ASIC"). The control circuitry also includes the cigarette sensor 57 for detecting the insertion of a cigarette 23 in the cigarette receiver 27 of the lighter 25, the puff sensor 45 for detecting a draw upon the inserted cigarette 23, the LCD indicator 51 for indicating the number of puffs remaining on a cigarette, the power source 35*a* and a timing network 197.

The logic circuit 195 may comprise any conventional circuit capable of implementing the functions discussed herein. A field-programmable gate array (e.g., a type ACTEL A1280A FPGA PQFP 160, available from Actel Corporation, Sunnyvale, Calif.) or a micro controller can be programmed to perform the digital logic functions with analog functions performed by other components. An ASIC or micro-controller can perform both the analog and digital functions in one component. Features of control circuitry and logic circuitry similar to the control circuit 41 and logic circuit 195 of the present invention are disclosed, for example, in commonly assigned, U.S. Pat. Nos. 5,388,594; 5,505,214; 5,591,368; and 5,499,636, all which are hereby incorporated by reference in their entireties. Further details are also provided in commonly assigned U.S. Pat. No. 6,040,560, hereby incorporated by reference in its entirety.

In the preferred embodiment, eight individual heater elements 37 are connected to a positive terminal of the power source 35*a* and to ground through corresponding field effect transistor (FET) heater switches 201–208. Individual (or selected) ones of the heater switches 201–208 will turn on under control of the logic circuit 195 through terminals 211–218, respectively, during execution of a power cycle by the logic circuit 195. The logic circuit 195 provides signals for activating and deactivating particular ones of the heater switches 201–208 to activate and deactivate the corresponding heater element 37 of the heater fixture 39.

The logic circuit 195 cooperates with the timing circuit 197 to precisely execute the activation and deactivation of each heater element 37 in accordance with a predetermined total cycle period ("$T_{total}$") and to precisely divide each total cycle period into a predetermined number of phases, with each phase having its own predetermined period of time ("$t_{phase}$"). In the preferred embodiment, the total cycle period $T_{total}$ has been selected to be 1.6 seconds (so as to be less than the two-second duration normally associated with a smoker's draw upon a cigarette, plus provision for margin) and the total cycle period $T_{total}$ is divided preferably into two phases, a first phase having a predetermined time period ("$t_{phase\ 1}$") of 1.0 seconds and a second phase having a predetermined time period ("$t_{phase\ 2}$") of 0.6 seconds. The total cycle period $T_{total}$, the total number of phases and the respective phase periods are parameters, among others, that are resolved in accordance with the teachings which follow for establishing within the control circuit 41, a capacity to execute a power cycle that precisely duplicates a preferred thermal interaction ("thermal profile" or "thermo-histogram") between the respective heater element 37 and adjacent portions of the cigarette 23. Additionally, once the preferred thermo-histogram is established, certain parameters (preferably, duty cycles within each phase) are adjusted dynamically by the control circuit 41 so as to precisely duplicate the predetermined thermo-histogram with every power cycle throughout the range of voltages $v_{in}$encompassed by the aforementioned battery discharge cycle.

The puff-actuated sensor 45 supplies a signal to the logic circuit 195 that is indicative of smoker activation (i.e., a continuous drop in pressure or air flow over a sufficiently sustained period of time). The logic circuit 195 includes a debouncing routine for distinguishing between minor air pressure variations and more sustained draws on the cigarette to avoid inadvertent activation of heater elements in response to errant signal from the puff-actuated sensor 45. The puff-actuated sensor 45 may include a piezoresistive pressure sensor or an optical flap sensor that is used to drive an operational amplifier, the output of which is in turn used to supply a logic signal to the logic circuit 195. Puff-actuated sensors suitable for use in connection with the smoking system include a Model 163PCO1D35 silicon sensor, manufactured by the MicroSwitch division of Honeywell, Inc., Freeport, Ill., or a type NPH-5-02.5G NOVA sensor, available from Lucas-Nova, Fremont, Calif., or a type SLP004D sensor, available from SenSym Incorporated, Sunnyvale, Calif.

The cigarette sensor 57 is located at the cigarette receiver 27 and supplies a signal to the logic circuit 195 that is indicative of insertion of a cigarette 23 in the lighter 25. Optionally a second sensor may be located adjacent the stop 183 so as to determine whether the cigarette has been fully inserted into the receiver 27.

In order to conserve energy, it is preferred that the puff-actuated sensor 45 and the cigarette sensor 57 be cycled on and off at low duty cycles (e.g., from about a 2 to 10% duty cycle). For example, it is preferred that the puff actuated sensor 45 be turned on for a 1 millisecond duration every 10 milliseconds. If, for example, the puff actuated sensor 45 detects pressure drop or air flow indicative of a draw on a cigarette during four consecutive pulses (i.e., over a 40 millisecond period), the puff actuated sensor sends a signal through a terminal 221 to the logic circuit 195. The logic circuit 195 then sends a signal through an appropriate one of the terminals 211–218 to turn an appropriate one of the FET heater switches 201–208 ON.

Similarly, the cigarette sensor 57 is preferably turned on for a 1 millisecond duration every 10 milliseconds. If, for example, the cigarette sensor 57 detects four consecutive reflected pulses, indicating the presence of a cigarette 23 in the lighter 25, the light sensor sends a signal through terminal 223 to the logic circuit 195. The logic circuit 195 then sends a signal through terminal 225 to the puff-actuated sensor 45 to turn on the puff-actuated sensor. The logic circuit 195 also sends a signal through terminal 227 to the indicator 51 to turn it on. The above-noted modulation techniques reduce the time average current required by the puff actuated sensor 45 and the cigarette sensor 57, and thus extend the life of the power source 37.

The logic circuit 195 includes a PROM (programmable read-only memory) 301, which includes preferably at least two data bases or "look-up tables" 302 and 304, and optionally, a third data base (look-up table) 306 and possibly a fourth look-up table 307. Each of the look-up tables 302, 304 (and optionally 306, 307) converts a signal indicative of battery voltage $v_{in}$ to a signal indicative of the duty cycle ("$dc_1$" for the first phase and "$dc_2$" for the second phase) to be used in execution of the respective phase of the immediate power cycle. Third and fourth look-up tables 306 and 307 function similarly.

Upon initiation of a power cycle, the logic circuit receives a signal indicative of battery voltage $v_{in}$, and then references the immediate reading $v_{in}$ to the first look-up table 302 to establish a duty cycle $dc_1$ for the initiation of the first phase of the 30 power cycle. The first phase is continued until the timing network 197 provides a signal indicating that the predetermined time period of the first phase ($t_{phase\ 1}$) has elapsed, whereupon the logic circuit 195 references $V_{in}$ and the second look-up table 304 and establishes a duty cycle $dc_2$ for the initiation the second phase. The second phase is continued until the timing network 197 provides a signal indicating that the predetermined time period of the second phase ($t_{phase\ 2}$) has elapsed, whereupon the timing network 197 provides a shut-off signal to the logic circuit 195 at the terminal 229. Optionally, the logic circuit 195 could initiate a third phase and establish a third duty cycle $dc_3$, and the shut-off signal would not be generated until the predetermined period of the third phase ($t_{phase\ 3}$) had elapsed. A similar regimen could optionally be established with a fourth phase ($t_{phase\ 4}$). The present invention could be practiced with additional phases as well.

Although the present invention can be practiced by limiting reference to the look-up tables to an initial portion of each phase to establish a duty cycle to be applied throughout the substantial entirety of each phase, a refinement and the preferred practice is to have the logic circuit 195 configured to continuously reference $v_{in}$ together with the respective look-up tables 302, 303, 306 and 307 so as to dynamically adjust the values set for duty cycles in response to fluctuations in battery voltage as the control circuit progresses through each phase. Such device provides a more precise repetition of the desired thermo-histogram.

Other timing network circuit configurations and logic circuits may also be used, such as those described in the commonly assigned, U.S. Pat. Nos. 5,388,594; 5,505,214; 5,591,368; 5,499,636; and 5,372,148, all which are hereby incorporated by reference in their entireties.

During operation, a cigarette 23 is inserted in the lighter 25 and the presence of the cigarette is detected by the cigarette sensor 57. The cigarette sensor 57 sends a signal to the logic circuit 195 through terminal 223. The logic circuit 195 ascertains whether the power source 35*a* is charged or whether the immediate voltage is below an acceptable minimum $v_{in\ min}$. If, after insertion of a cigarette 23 in the lighter 25, the logic circuit 195 detects that the voltage of the power source 35*a* is too low, below $v_{in\ min}$, the indicator 51 blinks and further operation of the lighter will be blocked until the power source 35*a* is recharged or replaced. Voltage of the power source 35*a* is also monitored during firing of the heater elements 37 and the firing of the heater elements 37 is interrupted if the voltage drops below a predetermined value.

If the power source 35*a* is charged and voltage is sufficient, the logic circuit 195 sends a signal through terminal 225 to the puff sensor 45 to determine whether a smoker is drawing on the cigarette 23. At the same time, the logic circuit 195 sends a signal through the terminal 227 to the indicator 51 so that the LCD will display the digit "8", reflecting that eight puffs are available.

When the logic circuit 195 receives a signal through terminal 221 from the puff-actuated sensor 45 that a sustained pressure drop or air flow has been detected, the logic circuit 195 sends a signal through terminal 231 to the timer network 197 to activate the timer network, which then begins to function phase by phase in the manner previously described. The logic circuit 195 also determines, by a downcount routine, which one of the eight heater elements is due to be heated and sends a signal through an appropriate terminal 211–218 to turn an appropriate one of the FET heater switches 201–208 ON. The appropriate heater stays on while the timer runs.

When the timing network 197 sends a signal through terminal 229 to the logic circuit 195 indicating that the timer has stopped running, the particular ON FET heater switch 211–218 is turned OFF, thereby removing power from the particular heater element 37. The logic circuit 195 also downcounts and sends a signal to the indicator 51 through terminal 227 so that the indicator will display that one less puff is remaining (e,g., "7", after the first puff). When the smoker next puffs on the cigarette 23, the logic circuit 195 will turn ON another predetermined one of the FET heater switches 211–218, thereby supplying power to another predetermined one of the heater elements. The process will be repeated until the indicator 51 displays "0", meaning that there are no more puffs remaining on the cigarette 23. When the cigarette 23 is removed from the lighter 25, the cigarette sensor 57 indicates that a cigarette is not present, and the logic circuit 195 is reset.

Other features, such as those described in U.S. Pat. No. 5,505,214; 5,388,594; and 5,372,148 which are incorporated by reference, may be incorporated in the control circuitry 41 instead of or in addition to the features described above. For example, if desired, various disabling features may be provided. One type of disabling feature includes timing circuitry (not shown) to prevent successive puffs from occurring too close together, so that the power source 35*a* has time to recover. Another disabling feature includes means for disabling the heater elements 37 if an unauthorized product is inserted in the heater fixture 39. For example, the cigarette 23 might be provided with an identifying characteristic that the lighter 25 must recognize before the heating elements 37 are energized.

Figure 6:
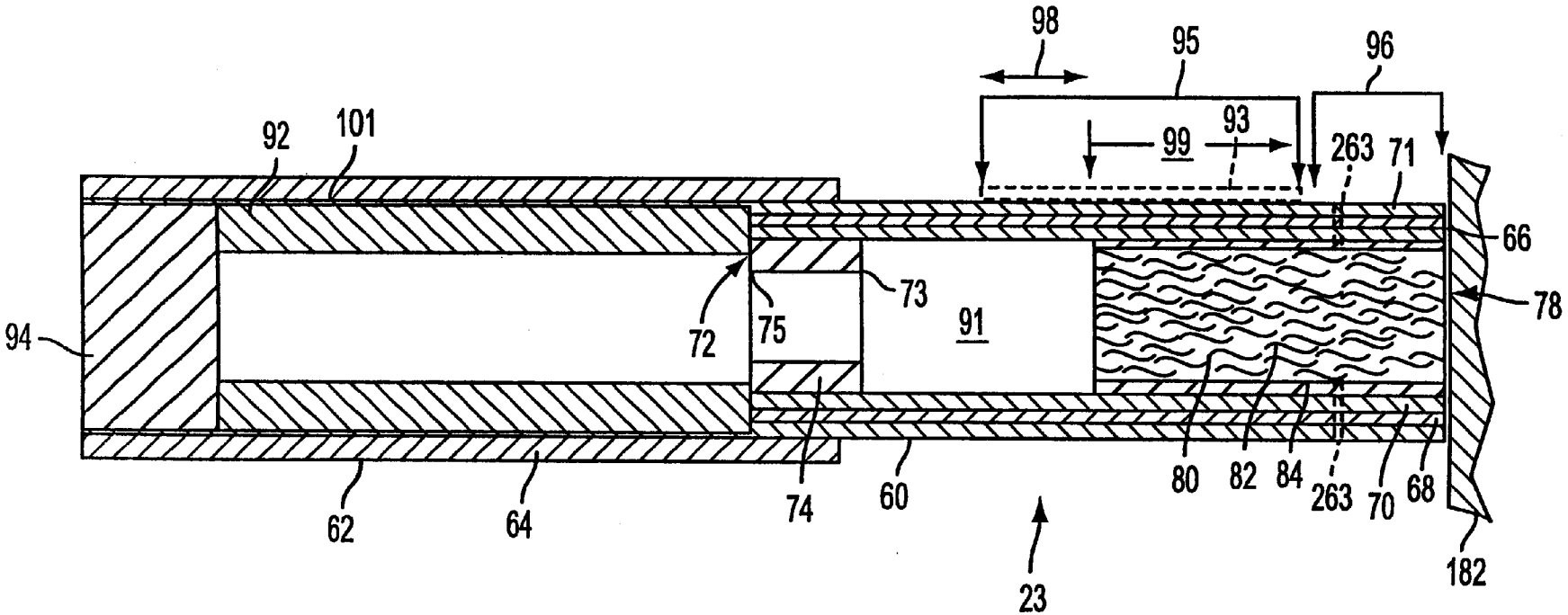
FIG. 6 is a side cross sectional view of the cigarette shown in FIG. 4 wherein a free end of the cigarette is in contact with a stop piece in the lighter.

Referring now to FIG. 6, the cigarette 23, as constructed in accordance with the preferred embodiment of the present invention, comprises a tobacco rod 60 and a filter tipping 62, which are joined together with tipping paper 64. During manufacture of the cigarette, perforation holes 263 can be provided in one or more locations in the outer surface of the tobacco rod 60.

The partially-filled, filter cigarette 23 preferably has an essentially constant diameter along its length and, which like more traditional cigarettes, is preferably between approximately 7.5 mm and 8.5 mm in diameter so that the smoking system 21 provides a smoker a familiar "mouth feel". In the preferred embodiment, the cigarette 23 is approximately 62 mm in overall length, thereby facilitating the use of conventional packaging machines in the packaging of the cigarettes 23. The combined length of the mouthpiece filter 94 and the free-flow filter 92 is preferably 30 mm. The tipping paper preferably extends approximately 6 mm over the tobacco rod 60. The total length of the tobacco rod 60 is preferably 32 mm. Other proportions, lengths and diameters may be selected instead of those recited above for the preferred embodiment.

The tobacco rod 60 of the cigarette 23 preferably includes a tobacco web or mat 66 which has been folded into a tubular (cylindrical) form.

An overwrap 71 intimately enwraps the tobacco web 66 and is held together along a longitudinal seam as is common in construction of more traditional cigarettes. The overwrap 71 retains the tobacco web 66 in a wrapped condition about a free-flow filter 74 and a tobacco plug 80.

Preferably, the cigarette overwrap paper 71 is wrapped intimately about the tobacco web 66 so as to render external appearance and feel of a more traditional cigarette. It has been found that a better tasting smoke is achieved when the overwrap paper 71 is a standard type of cigarette paper, preferably a flax paper of approximately 20 to 50 CORESTA (defined as the amount of air, measured in cubic centimeters, that passes through one square centimeter of material, e.g., a paper sheet, in one minute at a pressure drop of 1.0 kilopascal) and more preferably of about 30 to 45 CORESTA, a basis weight of approximately 23 to 35 grams per meter squared ($g/m^2$) and more preferably about 23 to 30 $g/m^2$, and a filler loading of approximately 23 to 35% by weight and more preferably 28 to 33% by weight. The overwrap paper 71 preferably contains little or no citrate or other burn modifiers, with preferred levels of citrate ranging from 0 to approximately 2.6% by weight of the overwrap paper 71 and more preferably less than 1%.

The tobacco web 66 itself preferably comprises a base web 68 and a layer of tobacco material 70 located along the inside surface of the base web 68. At the tipped end 72 of the tobacco rod 60, the tobacco web 66 together with the overwrap 71 are wrapped about the tubular free-flow filter plug 74. The free-flow filter 74 (also known in the art as "whistle-through" plugs) provides structural definition and support at the tipped end 72 of the tobacco rod 60 and permits aerosol to be withdrawn from the interior of the tobacco rod 60 with a minimum pressure drop. The free-flow filter 74 also acts as a flow constriction at the tipped end 72 of the tobacco rod 60, which is believed to help promote the formation of aerosol during a draw on the cigarette 23. The free-flow filter is preferably at least 7 millimeters long to facilitate machine handling and is preferably annular, although other shapes and types of low efficiency filters are suitable, including cylindrical filter plugs.

At the free end 78 of the tobacco rod 60, the tobacco web 66 together with the overwrap 71 are wrapped about a cylindrical tobacco plug 80. Preferably, the tobacco plug 80 is constructed separately from the tobacco web 66 and comprises a relatively short column of cut filler tobacco that has been wrapped within and retained by a plug wrap 84.

Preferably the tobacco plug 80 is constructed on a conventional cigarette rod making machine wherein cut filler (preferably blended) is air formed into a continuous rod of tobacco on a traveling belt and entrapped with a continuous ribbon of plug wrap 84 which is then glued along its longitudinal seam and heat sealed. In accordance with the preferred embodiment of the present invention, the plug wrap 84 is preferably constructed from a cellulosic web of little or no filler, sizing or burn additives (each at levels below 0.5% weight percent) and preferably little or no sizing. Preferably, the tobacco plug wrap 84 has a low basis weight of below 15 grams per meter squared and more preferably about 13 grams per meter squared. The tobacco plug wrap 84 preferably has a high permeability in the range of about 20,000 to 35,000 CORESTA and more preferably in the range of about 25,000 to 35,000 CORESTA, and is constructed preferably from soft wood fiber pulp, abaca-type cellulose or other long fibered pulp. Such papers are available from Papierfabrik Schoeller and Hoescht GMBH, Postfach 1155, D-76584, Gernsback, GERMANY; another paper suitable for use as the plug wrap 84 is the paper TW 2000 from DeMauduit of Euimperle FRANCE, with the addition of carboxy-methyl cellulose at a 2.5 weight percent level.

The tobacco rod making machine is operated so as to provide a tobacco rod density of approximately 0.17 to 0.30 grams per cubic centimeter (g/cc), but more preferably in a range of at least 0.20 to 0.30 g/cc and most preferably between about 0.24 to 0.28 g/cc. The elevated densities are preferred for the avoidance of loose ends at the free end 78 of the tobacco rod 60. However, it is to be understood that the lower rod densities will allow the tobacco column 82 to contribute a greater proportion of aerosol and flavor to the smoke. Accordingly, a balance must be struck between aerosol delivery (which favors a low rod density in the tobacco column 82) and the avoidance of loose-ends (which favors the elevated ranges of rod densities).

The tobacco column 82 preferably comprises cut filler of a blend of tobaccos typical of the industry, including blends comprising bright, burley and oriental tobaccos together with, optionally, reconstituted tobaccos and other blend components, including traditional cigarette flavors. However, in the preferred embodiment, the cut filler of the tobacco column 84 comprises a blend of bright, burly and oriental tobaccos at the ratio of approximately 45:30:25 for the U.S. market, without inclusion of reconstituted tobaccos or any after cut flavorings. Optionally, an expanded tobacco component might be included in the blend to adjust rod density, and flavors may be added.

The continuous tobacco rod formed as described above is sliced in accordance with a predetermined plug length for the tobacco plug 80. This length is preferably at least 7 mm in order to facilitate machine handling. However, the length may vary from about 7 mm to 25 mm or more depending on preferences in cigarette design which will become apparent in the description which follows, with particular reference to FIG. 7.

As a general matter, the length of the tobacco plug 80 is preferably set relative to the total length of the tobacco rod 60 such that a void 91 is defined along the tobacco rod 60 between the free-flow filter 74 and the tobacco plug 80. The void 91 corresponds to an unfilled portion of the tobacco rod 60 and is in immediate fluid communication with the tipping 62 through the free flow filter 74 of the tobacco rod 60.

Referring particularly to FIG. 6, the length of the tobacco plug 80 and its relative position along the tobacco rod 60 is also selected in relation to features of the heater elements 37. When a cigarette is properly positioned against a stop 182 within the lighter 25, a portion 93 of each heater element 37 will contact the tobacco rod 60 along a region of the tobacco rod 60. This region of contact is referred to as a heater footprint 95. The heater footprint 95 (as shown with a double arrow in FIG. 2) is not part of the cigarette structure itself, but instead is a representation of that region of the tobacco rod 60 where the heater element 37 would be expected to reach operative heating temperatures during smoking of the cigarette 23. Because the heating elements 37 are a fixed distance 96 from the stop 182 of the heater fixture, the heater foot print 95 consistently locates along the tobacco rod 60 at the same predetermined distance 96 from the free end 78 of the tobacco rod 60 for every cigarette 23 that is fully inserted into the lighter 25.

Preferably, the length of the tobacco plug 80, the length of the heater footprint 95 and the distance between the heater footprint 95 and the stop 182 are selected such that the heater footprint 95 extends beyond the tobacco plug 80 and superposes a portion of the void 91 by a distance 98. The distance 98 by which the heater footprint 95 superposes the void 91 (the unfilled portion of the tobacco rod 60) is also referred to as the "heater-void overlap" 98. The distance by which the remainder of the heater footprint 95 superposes the tobacco plug 80 is referred to as the "heater-filler overlap" 99.

The tipping 62 preferably comprises a free-flow filter 92 located adjacent the tobacco rod 60 and a mouthpiece filter plug 94 at the distal end of the tipping 62 from the tobacco rod 60. Preferably the free-flow filter 92 is tubular and transmits air with very little pressure drop. Other low efficiency filters of standard configuration could be used instead, however. The inside diameter for the free flow filter 92 is preferably at or between 2 to 6 millimeters and is preferably greater than that of the free flow filter 74 of the tobacco rod 60.

The mouthpiece filter plug 94 closes off the free end of the tipping 62 for purposes of appearance and, if desired, to effect some filtration, although it is preferred that the mouthpiece filter plug 94 comprise a low efficiency filter of preferably about 15 to 25 percent efficiency.

The free-flow filter 92 and the mouthpiece filter plug 94 are preferably joined together as a combined plug with a plug wrap 101. The plug wrap 101 is preferably a porous, low weight plug wrap as is conventionally available to those in the art of cigarette making. The combined plug is attached to the tobacco rod 60 by the tipping paper 64 of specifications that are standard and conventionally used throughout the cigarette industry. The tipping paper 64 may be either cork, white or any other color as decorative preferences might suggest.

Preferably, a cigarette 23 constructed in accordance with the preferred embodiment has an overall length of approximately 62 mm, of which 30 mm comprises the combined plug of the tipping 62. Accordingly, the tobacco rod 60 is 32 mm long. Preferably, the free-flow filter 74 of the tobacco rod 60 is at least 7 mm long and the void 91 between the free-flow filter 74 and the tobacco plug 80 is preferably at least 7 mm long. In the preferred embodiment, the heater foot print 95 is approximately 12 mm long and located such that it provides a 3 mm heater-void overlap 98, leaving 9 mm of the heater foot print 95 superposing the tobacco plug 80.

It is to be understood that the length of the void 91, the length of the tobacco plug 80, and the distribution of the perforation holes 263 may be adjusted to facilitate manufacturing and more importantly, to adjust the smoking characteristics of the cigarette 23, including adjustments in its taste, draw and delivery. The pattern of holes 263, the length of the void 91 and the amount of heater-filler overlap (and heater-void overlap) may also be manipulated to adjust the immediacy of response, to promote consistency in delivery (on a puff-to-puff basis as well as between cigarettes) and to control condensation of aerosol at or about the heaters.

In the preferred embodiment, the void 91 (the filler-free portion of the tobacco rod 60) extends approximately 7 mm to assure adequate clearance between the heater foot print 95 and the free-flow filter 74. In this way, margin is provided such that the heater foot print 95 does not heat the free-flow filter 74 during smoking. Other lengths are suitable, for instance, if manufacturing tolerances permit, the void 91 might be configured as short as approximately 4 mm or less, or in the other extreme, extended well beyond 7 mm so as establish an elongate filler-free portion along the tobacco rod 60. The preferred range of lengths for the filler-free portion (the void 91) is from approximately 4 mm to 18 mm and more preferably 5 to 12 mm.

In another embodiment, a cigarette 23 has an overall length of approximately 68 mm, of which 36 mm comprises the combined plug of the tipping 62. Accordingly, the tobacco rod 60 is 32 mm long. Preferably, the free-flow filter 74 of the tobacco rod 60 is at least 13 mm long and the void 91 between the free-flow filter 74 and the tobacco plug 80 is preferably at least 7 mm long.

Regardless of the length of the cigarette, the cigarette can include filter material, e.g., the void space can contain filter material such as activated carbon, flavored carbon, silica gel particles, or other filtering material. Also, the controller can be programmed to operate the heater fixture so as to warm the cigarette upon insertion thereof into the EHCSS. For example, the control circuitry can be operable to cause delivery of energy to the heater blades (e.g., about 5–6 Joules) to thereby warm the cigarette such that moisture moves from the wrapper into the central portion of the cigarette.

During smoking of the cigarette, the controller preferably activates one of the heating blades to apply heat to a heating zone along the outer periphery of the cigarette. For example, the zone can range in size from 3 to 25 $mm^2$ as mentioned in commonly assigned U.S. Pat. No. 5,750,964 incorporated herein by reference. A preferred heating zone for a cigarette having a wrapper with an ammonium containing compound filler therein has a length of 10 to 20 mm and covers an area of 10 to 20 $mm^2$ and the preferred amount of heat applied to the heating blade in accordance with a programmed power cycle is 15 to 40 Joules, preferably 20 to 35 Joules. With such heating, the heating zone can be heated to a temperature of up to 500° C. and the tobacco mat can be heated to a temperature of about 200 to 350° C., preferably 220 to 320° C. Due to resistance heating of the heater blade, the temperature of the blade may be somewhat lower at each longitudinal end thereof, e.g., the temperature of the blade may be 25 to 50° C. higher in the central portion of the blade when the blade reaches its maximum temperature.

It has been found that the controlled heating of the heated blade in combination with use of a cigarette wrapper having an ammonium containing compound filler results in reduction in various constituents of the tobacco smoke. A preferred ammonium containing compound filler is ammonium magnesium phosphate (AMP) and the heater blade is preferably supplied 20 to 35 Joules of energy according to the aforementioned programmed power cycle when activated by the controller. A preferred temperature of the tobacco mat along the heating zone during heating of a heater blade is 200 to 400° C., more preferably 220 to 320° C. Also, it is preferred that the cigarette include laser perforations and/or mat holes as discussed above. Moreover, it is preferred that the EHCSS occlude the free end of the cigarette to minimize flow of ambient air into the free end and include an air swoop to direct ambient air towards the laser perforations and/or mat holes as discussed above.

According to the invention, the EHCSS is used to smoke a cigarette wherein the cigarette wrapper includes an ammonium containing compound filler such as magnesium ammonium phosphate (AMP), preferably the monohydrate form of AMP in an amount effective to reduce the contents of a plurality of gaseous components in the smoke produced by combustion/pyrolysis of the cigarette. Compared to cigarette paper wherein calcium carbonate is the sole filler, when the ammonium containing compound filler is used it is possible to reduce the amounts of gas constituents in the mainstream smoke of the smoking system, such constituents including aldehydes (e.g., formaldehyde, acetaldehyde, propionaldehyde), carbon monoxide, 1,3-butadiene, isoprene, acrolein, acrylonitrile, hydrogen cyanide, o-toluidine, 2-naphtylamine, nitrogen oxide, benzene, NNN, phenol, catechol, benz(a)anthracene, benzo(a)pyrene, etc.

Figure 7:
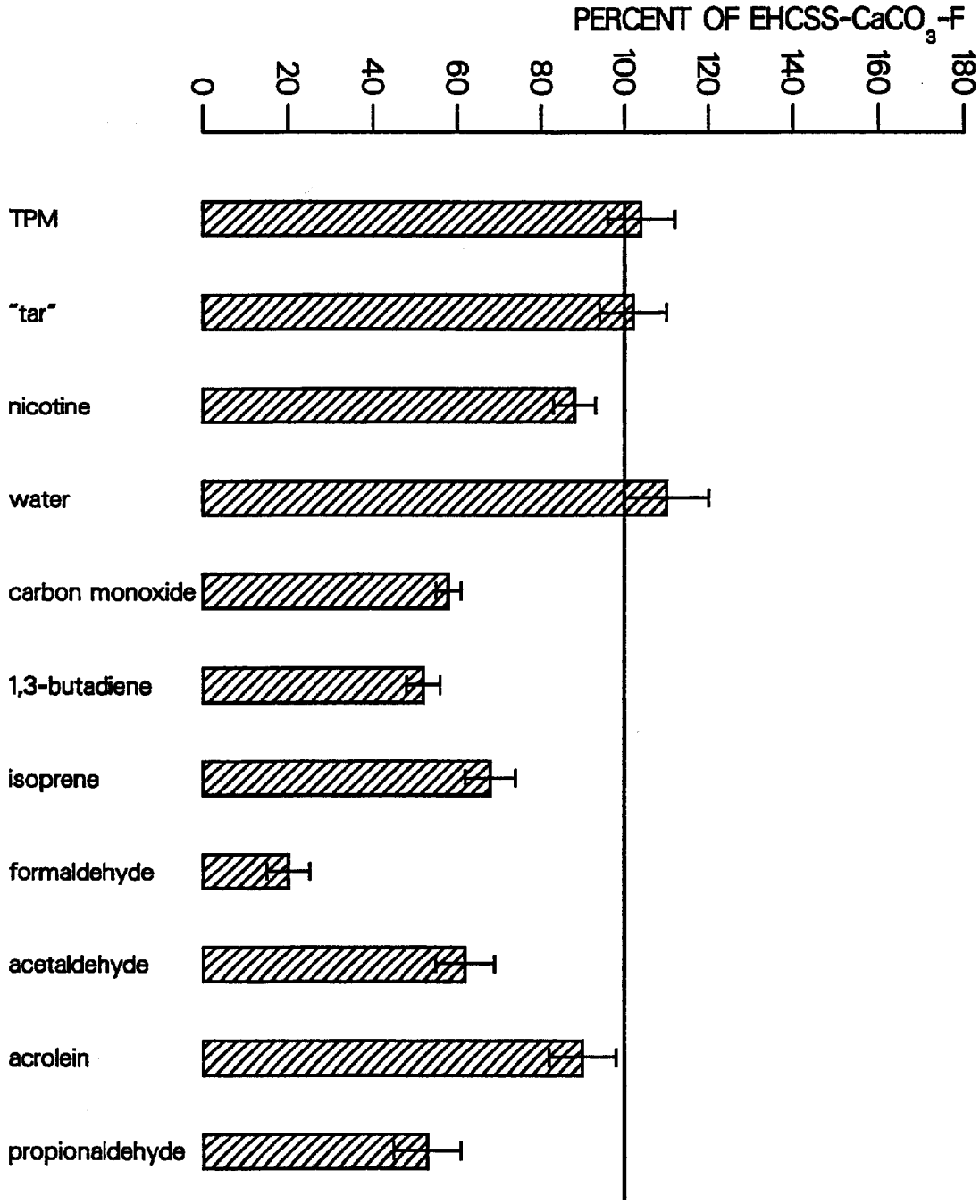
FIGS. 7 and 8 are graphs showing reduction of various gaseous components of tobacco smoke generated with the smoking system according to the invention.
Figure 8:
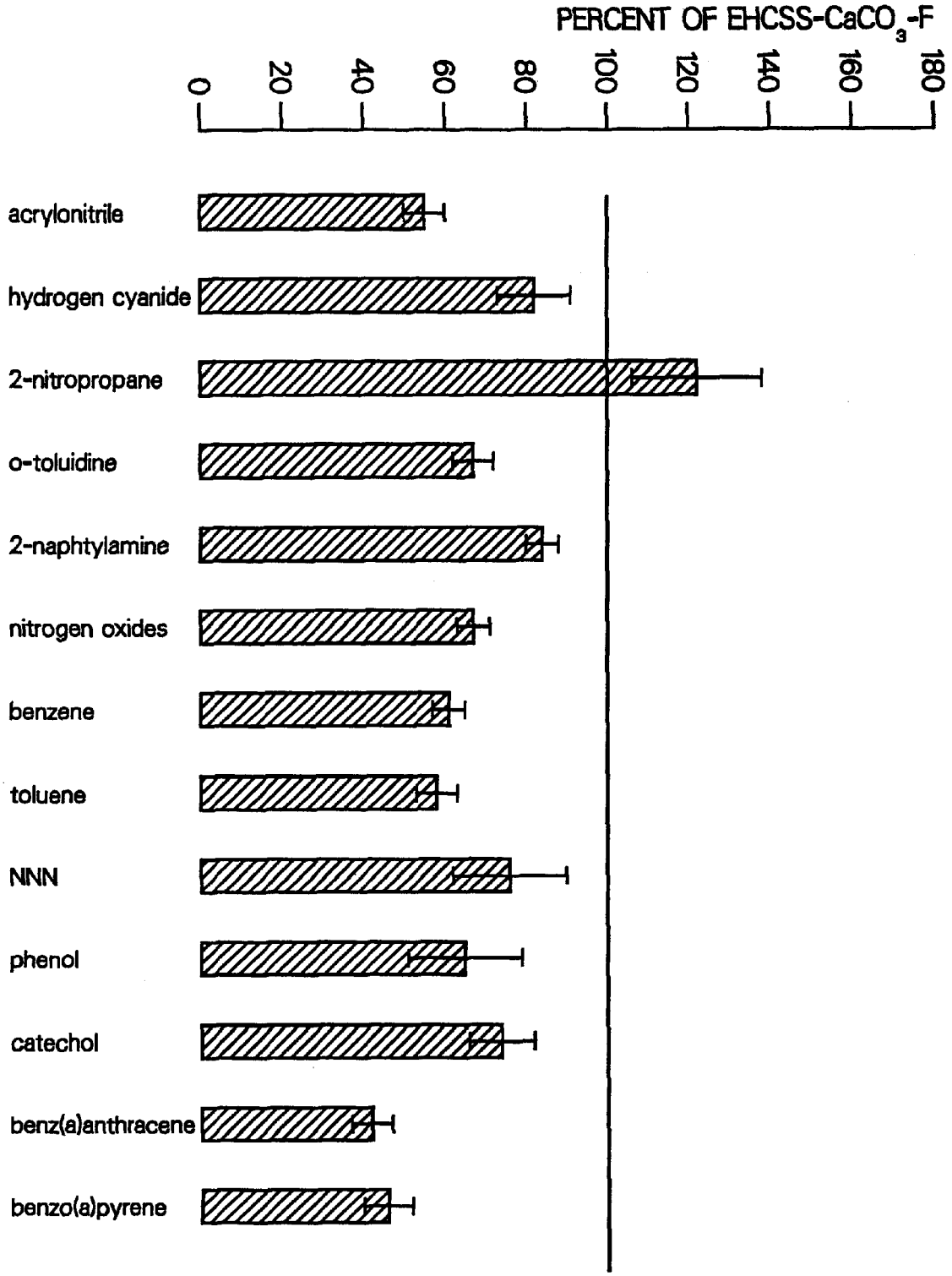

FIGS. 7–8 show results of relative measurements of tobacco smoke constituents produced in an EHCSS using cigarettes with ammonium containing compound filler (i.e., the monohydrate form of AMP) compared to $CaCO_3$ filler. As shown, the general levels of smoke constituents such as TPM, tar, and water are substantially the same for both cigarettes whereas nicotine and acrolein levels are reduced somewhat and the remaining constituents are dramatically reduced for the ammonium containing compound filler. One constituent which was not reduced in the tests was 2-nitropropane. Also, while not shown in FIGS. 7–8, the ammonia levels in the tobacco smoke are elevated for ammonium containing compound filler.

When compared to a conventional light standard reference cigarette (1R4F), the electrically heated cigarette according to the invention with ammonium magnesium phosphate (AMP) incorporated into the paper wrapper yields approximately 90% lower concentrations of carbon monoxide, 1,3-butadiene, acrylonitrile, benzene, and benzo (a)pyrene on a per mg TPM basis compared to the conventional light standard reference cigarette (1R4F). Aldehydes were 40% lower (one exception, formaldehyde, was 75% higher).

The wrapper according to the invention can be manufactured by conventional papermaking processes wherein a filler, of low solubility, effective in reducing the content of gaseous components in smoke is added either by itself or as a mixture with other filler materials to an aqueous slurry containing cellulosic material.

The monohydrate form of AMP ($MgNH_4PO_4.xH_2O$ wherein x is 1) has a low solubility in water so as to be compatible with conventional papermaking processes, e.g., the filler is substantially insoluble in an aqueous dispersion containing ingredients of the paper such as flax, etc. That is, the ammonium containing compound filler is stable enough in a papermaking process to survive intact as filler in the final paper product. This includes sufficient thermal stability to survive the drying steps in the papermaking process. The ammonium containing compound filler also evolves ammonia during the smoking process while decreasing the content of gaseous constituents such as low molecular weight aldehydes in smoke. The monohydrate form of AMP (mono-AMP) is also known as dittmarite and can be derived from raw ingredients or converted into the mono-form from the hexavalent form known as struvite. The mono-AMP can be provided with a range of surface areas, a range of particle sizes (mostly in the micron range), possess appropriate opacity, have low solubility in water (required for papermaking), and possess other properties that are considered desirable in fillers for cigarette papers. For purposes of a filler for cigarette paper, the mono-AMP preferably has a particle size below 25 $\mu$m, more preferably below 10 $\mu$m.

When used as filler in the fabrication of wrappers for cigarettes of an EHCSS, a preferred amount of the ammonium containing compound filler is equal to about 10% to about 60% of the final wrapper weight, more preferably about 20% to about 50% by weight. This percentage is referred to as the filler loading. Although the ammonium containing compound filler is preferably the sole filler, it can be mixed with one or more other fillers in the paper. In the case of mixtures, a portion, e.g., up to 60% by weight, of the filler loading can comprise one or more inorganic carbonate, inorganic hydroxide, inorganic oxide, or inorganic phosphate. Examples of such fillers include, e.g., calcium carbonate, magnesium hydroxide, magnesium oxide, magnesium carbonates, and titanium dioxide as well as other fillers known in the art.

The wrappers containing the ammonium containing compound filler can have a basis weight of between about 15 to about 75 grams per square meter and can have a porosity of between about 2 to about 200 cubic centimeters per minute per square centimeter as measured by the CORESTA method ("CORESTA units"). A preferred basis weight is between about 20 to about 50 grams per square meter and the most preferred porosity is between about 10 to about 110 CORESTA units. A more preferred basis weight is between about 25 to about 30 grams per square meter and the most preferred porosity is between about 25 to about 50 CORESTA units.

Burn additives such as alkali metal salts of carboxylic acids or phosphoric acids can be applied to the wrapper to adjust or control the burn rate of the resulting smoking article. For example, burn additives can be applied in amounts ranging from about 2% to about 15% by weight of the wrapper. Examples of burn additives include sodium fumarate, sodium citrate, potassium citrate, potassium succinate, potassium monohydrogen phosphate, and potassium dihydrogen phosphate.

To prepare wrappers containing the ammonium containing compound filler, conventional cigarette papermaking procedures can be used with the inclusion of an ammonium-containing compound filler in place of or in combination with a conventional cigarette paper filler such as calcium carbonate. The paper wrappers may be made from flax, wood pulp, or other plant fibers. In addition, the paper wrappers may be a conventional one wrapper construction, a multiwrapped construction or a multilayer single wrap construction.

If the ammonium containing compound filler comprises the monohydrate form of magnesium ammonium phosphate, it can be incorporated in the cigarette paper as follows. For instance, a slurry of the monohydrate form of magnesium ammonium phosphate can be mixed with feedstock of a paper making machine or the slurry can be dried to particle form (e.g., powder) and such powder can be incorporated in the paper making feedstock. In order to prevent the magnesium ammonium phosphate in the monohydrate form from transforming back to the hexahydrate form, it is desirable to maintain the slurry above 55° C. until it is incorporated directly in feedstock (preferably heated above 60° C.) of the paper making machine or until the slurry is dried into particle form such as by flash drying which removes the water from the slurry under elevated temperature conditions. Once dry, the monohydrate form of the magnesium ammonium phosphate remains stable. The magnesium ammonium phosphate preferably has a particle size in the range of approximately 2 $\mu$m to 8 $\mu$m, more preferably in the range of 2 $\mu$m to 4 $\mu$m.

It is to be understood that the present invention may be embodied in other specific forms and process the use without departing from the spirit or essential characteristics of the present invention. Thus, while the invention has been illustrated and described in accordance with various preferred embodiments, it is recognized that variations and changes may be made therein without departing from the invention as set forth in the claims.

What is claimed is:

1. An electrical smoking system comprising:

a cigarette comprising a tubular tobacco mat partially filled with tobacco material so as to define a filled tobacco rod portion, the filled tobacco rod portion being adjacent a free end of cigarette, the cigarette including a wrapper surrounding the filled tobacco rod portion, the wrapper comprising a cellulosic web material and at least one filler therein, the filler comprising an ammonium containing compound in an amount effective to reduce the content of gaseous components in tobacco smoke produced upon combustion/pyrolysis of the tobacco rod portion; and a lighter comprising at least one heating blade and a controller adapted to control heating of the heater blade in accordance with a power cycle, the lighter arranged to at least partially receive the cigarette such that the heater blade heats a heating zone of the cigarette, the controller being operable to limit heating of the heating zone to no greater than 500° C. so as to produce tobacco smoke while reducing the content of at least one gaseous component in the tobacco smoke, the at least one gaseous component including carbon monoxide, 1,3-butadiene, isoprene, acrolein, acrylonitrile, hydrogen cyanide, o-toluidine, 2-naphtylamine, nitrogen oxide, benzene, NNN, phenol, catechol, benz(a)anthracene, and benzo(a) pyrene.

2. The electrical smoking system according to claim 1, wherein the controller limits heating of the heating zone to a temperature no greater than 450° C.

3. The electrical smoking system according to claim 1, wherein the heating zone covers an area of 10 to 20 $mm^2$ and the controller limits heating of the heater blade to heat the tobacco mat adjacent the heating zone to a temperature range of 200 to 350° C. by supplying the heating blade with 15 to 40 Joules of energy, preferably 20 to 35 Joules.

4. The electrical smoking system according to claim 1, wherein the lighter includes a heater fixture having a plurality of the heating blades and a socket which occludes an axial end of the tobacco rod portion.

5. A cigarette for use in an electrical smoking system, the cigarette comprising:

a tubular mat partially filled with tobacco material so as to define a filled tobacco rod portion, the filled tobacco rod portion being adjacent a free end of the cigarette, the cigarette including a wrapper surrounding the filled tobacco rod portion, the wrapper comprising a cellulosic web material and at least one filler therein, the filler comprising an ammonium containing compound in an amount effective to reduce the content of gaseous components in tobacco smoke produced upon combustion/pyrolysis of the tobacco rod portion; and further wherein the cigarette includes a zone of perforations spaced from the free end of the tobacco rod portion.

6. The cigarette as claimed in claim 5, wherein the cigarette includes filtering material.

7. The cigarette as claimed in claim 5, further comprising a plurality of circumferentially spaced-apart holes in the tubular tobacco mat, the holes being covered by the wrapper.

8. The cigarette as claimed in claim 7, wherein the tubular tobacco mat comprises a tubular base web and a layer of tobacco material disposed along an interior of the tubular base web, the holes extending through the base web and the layer of tobacco material.

9. The cigarette as claimed in claim 7, wherein the mat holes are approximately 1 mm in diameter and 6 in number, arranged in a row and the zone of perforations comprises one or two rows of perf-holes, each row having 12 perf-holes.

10. The cigarette as claimed in claim 5, wherein the filler comprises only ammonium magnesium phosphate filler.

11. The cigarette as claimed in claim 10, wherein the ammonium magnesium phosphate filler consists essentially of the monohydrate form of magnesium ammonium phosphate.

12. A method of using the electrical smoking system according to claim 1, comprising supplying electrical current from a battery to the heating blade in accordance with the power cycle, the power cycle being implemented by the controller in a manner such that the heater blade heats the heating zone of the cigarette so as to generate tobacco smoke while reducing the content of at least one gaseous component in the tobacco smoke, the at least one gaseous component including carbon monoxide, 1,3-butadiene, isoprene, acrolein, acrylonitrile, hydrogen cyanide, o-toluidine, 2-naphtylamine, nitrogen oxide, benzene, NNN, phenol, catechol, benz(a)anthracene, and benzo(a)pyrene.

13. The method according to claim 12, wherein heater blade heats the heating zone of the cigarette so as to generate tobacco smoke while reducing the content of carbon monoxide by at least about 40% compared to using the electrical smoking system to smoke the same type of cigarette having only calcium carbonate as the filler in the wrapper.

14. The method according to claim 12, wherein heater blade heats the heating zone of the cigarette so as to generate tobacco smoke while reducing the content of 1,3-butadiene by at least about 40% compared to using the electrical smoking system to smoke the same type of cigarette having only calcium carbonate as the filler in the wrapper.

15. The method according to claim 12, wherein heater blade heats the heating zone of the cigarette so as to generate tobacco smoke while reducing the content of isoprene by at least about 30% compared to using the electrical smoking system to smoke the same type of cigarette having only calcium carbonate as the filler in the wrapper.

16. The method according to claim 12, wherein heater blade heats the heating zone of the cigarette so as to generate tobacco smoke while reducing the content of acrolein by at least about 10% compared to using the electrical smoking system to smoke the same type of cigarette having only calcium carbonate as the filler in the wrapper.

17. The method according to claim 12, wherein heater blade heats the heating zone of the cigarette so as to generate tobacco smoke while reducing the content of formaldehyde by at least about 70%, acetaldehyde by at least about 30%, and propionaldehyde by at least about 40% compared to using the electrical smoking system to smoke the same type of cigarette having only calcium carbonate as the filler in the wrapper.

18. The method according to claim 12, wherein heater blade heats the heating zone of the cigarette so as to generate tobacco smoke while reducing the content of acrylonitrile by at least about 40% compared to using the electrical smoking system to smoke the same type of cigarette having only calcium carbonate as the filler in the wrapper.

19. The method according to claim 12, wherein heater blade heats the heating zone of the cigarette so as to generate tobacco smoke while reducing the content of hydrogen cyanide by at least about 20% compared to using the electrical smoking system to smoke the same type of cigarette having only calcium carbonate as the filler in the wrapper.

20. The method according to claim 12, wherein heater blade heats the heating zone of the cigarette so as to generate tobacco smoke while reducing the content of o-toluidine by at least about 30% compared to using the electrical smoking system to smoke the same type of cigarette having only calcium carbonate as the filler in the wrapper.

21. The method according to claim 12, wherein heater blade heats the heating zone of the cigarette so as to generate tobacco smoke while reducing the content of 2-naphtylamine by at least about 15% compared to using the electrical smoking system to smoke the same type of cigarette having only calcium carbonate as the filler in the wrapper.

22. The method according to claim 12, wherein heater blade heats the heating zone of the cigarette so as to generate tobacco smoke while reducing the content of nitrogen oxides by at least about 30% compared to using the electrical smoking system to smoke the same type of cigarette having only calcium carbonate as the filler in the wrapper.

23. The method according to claim 12, wherein heater blade heats the heating zone of the cigarette so as to generate tobacco smoke while reducing the content of benzene by at least about 40% compared to using the electrical smoking system to smoke the same type of cigarette having only calcium carbonate as the filler in the wrapper.

24. The method according to claim 12, wherein heater blade heats the heating zone of the cigarette so as to generate tobacco smoke while reducing the content of toulene by at least about 40% compared to using the electrical smoking system to smoke the same type of cigarette having only calcium carbonate as the filler in the wrapper.

25. The method according to claim 12, wherein heater blade heats the heating zone of the cigarette so as to generate tobacco smoke while reducing the content of NNN by at least about 25% compared to using the electrical smoking system to smoke the same type of cigarette having only calcium carbonate as the filler in the wrapper.

26. The method according to claim 12, wherein heater blade heats the heating zone of the cigarette so as to generate tobacco smoke while reducing the content of phenol by at least about 30% compared to using the electrical smoking system to smoke the same type of cigarette having only calcium carbonate as the filler in the wrapper.

27. The method according to claim 12, wherein heater blade heats the heating zone of the cigarette so as to generate tobacco smoke while reducing the content of catechol by at least about 25% compared to using the electrical smoking system to smoke the same type of cigarette having only calcium carbonate as the filler in the wrapper.

28. The method according to claim 12, wherein heater blade heats the heating zone of the cigarette so as to generate tobacco smoke while reducing the content of bena(a) anthracene by at least about 60% compared to using the electrical smoking system to smoke the same type of cigarette having only calcium carbonate as the filler in the wrapper.

29. The method according to claim 12, wherein heater blade heats the heating zone of the cigarette so as to generate tobacco smoke while reducing the content of benzo(a) pyrene by at least 50% compared to using the electrical smoking system to smoke the same type of cigarette having only calcium carbonate as the filler in the wrapper.

30. The method according to claim 12, wherein the filler ranges from about 10% to about 60% by weight based on the total weight of the wrapper, the wrapper is a single layer wrapper which includes at least one circumferential row of perforations, the wrapper has a basis weight of between about 15 $g/m^2$ to about 75 $g/m^2$ and a porosity of between about 2 CORESTA units to about 200 CORESTA units, and/or the wrapper includes from about 2% to about 15% by weight of a burn additive comprising at least one alkali metal salt of an acid selected from the group consisting of sodium fumarate, sodium citrate, potassium citrate, potassium succinate, potassium monohydrogen phosphate, and potassium dihydrogen phosphate.

31. The method according to claim 12, wherein the wrapper has a basis weight of between about 25 $g/m^2$ to about 35 $g/m^2$ and a porosity of between about 25 CORESTA units to about 45 CORESTA units, the amount of the filler ranges from about 20% to about 40% by weight based on the total weight of the wrapper, and/or the filler has an average particle size of less than 5 $\mu$m.

* * * * *